US010461460B2

(12) United States Patent
Froment et al.

(10) Patent No.: US 10,461,460 B2
(45) Date of Patent: Oct. 29, 2019

(54) DEVICE FOR SECURING ELECTRICAL CHARGING CABLES TOGETHER

(71) Applicant: Ingenico Group, Paris (FR)

(72) Inventors: Marion Froment, Loriol (FR); Olivier Blanc, Saint Peray (FR); Alain Soubirane, Bourg-les-Valence (FR)

(73) Assignee: INGENICO GROUP, Paris (FR)

( * ) Notice: Subject to any disclaimer, the term of this patent is extended or adjusted under 35 U.S.C. 154(b) by 0 days.

(21) Appl. No.: 15/518,313

(22) PCT Filed: Oct. 16, 2015

(86) PCT No.: PCT/EP2015/074059
§ 371 (c)(1),
(2) Date: Apr. 11, 2017

(87) PCT Pub. No.: WO2016/059233
PCT Pub. Date: Apr. 21, 2016

(65) Prior Publication Data

US 2017/0310039 A1 Oct. 26, 2017

(30) Foreign Application Priority Data

Oct. 17, 2014 (FR) ..... 14 59999

(51) Int. Cl.
*H01R 27/02* (2006.01)
*H01R 13/508* (2006.01)
(Continued)

(52) U.S. Cl.
CPC ..... *H01R 13/508* (2013.01); *H01R 13/512* (2013.01); *H01R 13/516* (2013.01);
(Continued)

(58) Field of Classification Search
CPC .... H01R 13/516; H01R 12/714; H01R 12/73; H01R 13/6461; H01R 13/6587; H01R 24/62; H01R 13/62938; H01R 12/721; H01R 13/639; H01R 25/14; H01R 43/26; H01R 13/506; H01R 13/514; H01R 13/60
See application file for complete search history.

(56) References Cited

U.S. PATENT DOCUMENTS 4,932,874 A * 6/1990 Hollopeter ..... G08B 13/1409 439/133
5,562,504 A * 10/1996 Moshayedi ..... G06K 19/07743 439/131

(Continued)

FOREIGN PATENT DOCUMENTS

EP 0718652 A2 6/1996
FR 2968433 B1 6/2016

*Primary Examiner* — Truc T Nguyen
(74) *Attorney, Agent, or Firm* — Benoit & Côté Inc.

(57) ABSTRACT

Device (1) for securing together cables for the electrical charging of an electronic apparatus (2), said electronic apparatus comprising two connectors (211, 221), each connector being connectable to a charging plug, characterized in that it comprises:

a first portion (3) for connection to a first connector (211), and a second portion (4) provided with a housing (45) for the insertion of a connection cable (6) dedicated to a second connector (221), said first portion (3) and said second portion (4) being secured together by securing means.

9 Claims, 5 Drawing Sheets

(51) Int. Cl.

| | |
|---|---|
| ***H01R 13/516*** | (2006.01) |
| ***H01R 13/512*** | (2006.01) |
| ***H01R 13/518*** | (2006.01) |
| *H01R 13/506* | (2006.01) |
| *H01R 13/514* | (2006.01) |

(52) U.S. Cl.
CPC ..... *H01R 13/518* (2013.01); *H01R 27/02* (2013.01); *H01R 13/506* (2013.01); *H01R 13/514* (2013.01)

(56) References Cited

U.S. PATENT DOCUMENTS 5,582,180 A * 12/1996 Manset ..... A61B 5/04286 439/135
6,182,169 B1 * 1/2001 Force, Sr. ..... G06F 1/1626 224/219
7,500,867 B1 * 3/2009 Doglio ..... H01R 13/5812 248/251
8,678,669 B2 * 3/2014 Lee ..... G02B 6/3879 257/E23.177
2003/0017742 A1 * 1/2003 Bond ..... G09F 3/205 439/491
2004/0097124 A1 * 5/2004 Garrett ..... H01R 13/6456 439/378
2007/0004280 A1 * 1/2007 Sun ..... H01R 13/514 439/594
2007/0010137 A1 * 1/2007 Sun ..... H01R 27/02 439/713
2007/0039755 A1 * 2/2007 Mori ..... F16L 3/13 174/480
2010/0029126 A1 * 2/2010 Ngo ..... H01R 13/6275 439/345
2010/0038113 A1 * 2/2010 Huang ..... H02G 3/32 174/135
2011/0065314 A1 3/2011 Vroom et al.
2012/0094527 A1 4/2012 Vroom et al.
2013/0262299 A1 10/2013 Lacroix et al.
2014/0066928 A1 * 3/2014 Bennett ..... A61B 17/32002 606/45
2015/0089774 A1 * 4/2015 Kalejaiye ..... H02G 3/32 24/122.3

* cited by examiner

DEVICE FOR SECURING ELECTRICAL CHARGING CABLES TOGETHER

1. FIELD OF THE INVENTION

The present invention relates to the field of electrical cabling and wiring. More specifically, the present invention relates to the field of electrical charging by cable. The present technique relates more particularly to the electrical charging of an electronic payment device comprising two connectors.

2. PRIOR ART

Traditionally, payment for goods and services at a sales point is made through a payment terminal connected to a cash register or computer.

Recently, we have seen the development of mobile electronic payment devices. In such a device, a payment terminal is fitted back-to-back with a communications terminal such as a portable telephone or a smartphone. Such electronic payment devices are especially used in mobile businesses or in businesses organized in the form of stores. For example, a merchant accompanying a client at a sales point and holding such an electronic payment device in his hand can validate products (or services) chosen by the customer through an application hosted in the communications terminal. When the customer wishes to finalize his purchases, the merchant at once presents the customer with his payment terminal having the communications terminal fitted to its back, in order to effect payment.

Such electronic payment devices, generally use a classic payment terminal, to the back of which is affixed a housing forming a casing into which the communications terminal is inserted. Such an electronic payment device is thus known from the application FR2968433. Such a device comprises a smartcard reader, and comprises a housing that can receive and hold a portable communications terminal and comprises means of connection with this portable communications terminal and data-processing means capable of receiving information on a payment and of exchanging data with a remote server through a telephone communication made by said portable communications terminal. Such a device has a housing for inserting the communications terminal. This housing for insertion has a hatch that enables the insertion and removal of the communications terminal by translation. The lower part of the communications terminal (the part comprising a female connector, for example a micro-USB connector or any other connector of this type) is inserted into the housing and then the upper part of the communications terminal is pushed so as to get fully inserted into the housing provided for this purpose. The hatch is then closed. When it has penetrated into the bottom of the housing, the female connector of the communications terminal is plugged into a corresponding male connector.

Different types of communications terminals can be used. To this end, it is enough to have available different housings respectively adapted to these different types of terminals: the adaptive part which corresponds to the insertion housing is shaped for a certain type of terminal. Such a housing can give access to an internal electronic connection card comprising:

- a first internal connector enabling the card to be connected to the connector of the payment terminal;
- a second internal connector enabling the card to be connected to the connector of the communications terminal; and

- a third external connector enabling the card to be connected to an external device.

This electronic connection card is used to connect the communications terminal and the payment terminal together. This is a physical connection and the card is inside the casing. In particular, these connectors are used to connect the entire device to an electrical charging cable (for example a USB cable) connected to an electrical source (for example a computer) in order to charge both the payment terminal and the communications terminal as is described in the patent application FR2968433.

One major drawback of these mobile electronic payment devices is that they are hardly upgradable: they are not compatible with any new type of communications terminal that is put on the market after these electronic payment devices themselves have been put on the market. For example, because of changes and developments in regulations and technologies, most of these new communications terminals are presently provided with a charging connector that is relatively standardized, with a limited number of connection pins. (By way of an example, we may cite the Apple© type communications terminals in which the old 30-pin connector has been replaced by a new 8-pin connector, or the Android© type communications terminal in which the micro-USB connector has gradually become more prevalent.)

Thus, these new types of communications terminals are no longer compatible with the connector of the electronic connection card. It is thus no longer possible, as was the case previously, to simultaneously charge the communications terminal and the payment terminal, via the electronic connection card, using only one cable.

Solutions have been devised to adapt these mobile electronic payment devices to developments in communications terminals, especially by:

- eliminating the internal connection card; and
- proposing a new format for housing the communications terminal. This new format replaces the former housing without any need to replace the totality of the electronic payment device.

However, this new housing does not resolve the question of the electrical charging of the payment terminal and the communications terminal. This means that the device has two connectors: one connector for the payment terminal and one connector for the communications terminal. The new payment device (formed by the payment terminal and the new housing) comprises two holes at its end to receive firstly a charging plug for the communications terminal and secondly a charging plug for the payment terminal.

Thus, two electrical charging cables need to be used instead of one as earlier, and these two cables have to be inserted into two holes close to each other. This handling operation proves to be impractical and subject to problems, especially that of making sure that the two plugs are correctly inserted into the two connectors, of preventing cables from getting entangled with each other, etc.

3. SUMMARY OF THE INVENTION

The present technique proposes an ergonomic and simple way to overcome the drawbacks of the prior-art solutions.

To this end, the proposed technique relates to a device for attaching or securing together cables for the electrical charging of an electronic apparatus, such an electronic apparatus comprising two connectors, each connector being connectable to a charging plug.

The securing device comprises:

a first portion for connection to a first connector, and a second portion provided with a housing for the insertion of a connection cable dedicated to a second connector, the first portion and said second portion being secured together by securing means.

Such a device for the securing together of cables enables the simultaneous insertion of two plugs into the two connectors of the electronic apparatus. It facilitates and accelerates the handling operations, especially for connectors close to each other. Indeed, without the help of the device, the cables would have to be connected one by one to the electronic apparatus, and the second cable would be all the more difficult to insert because of the proximity of the connectors.

The two-portion layout of the device especially facilitates the positioning of a cable in the housing for the insertion of the second portion. Besides, such a cable can be modified according to need, so as to correspond to the corresponding connector of the electronic apparatus.

According to one particular characteristic, the securing means comprise a T-shaped groove formed on the upper surface of the first portion and a tab or tongue formed on the lower surface of the second portion.

This enables the tab of the second portion to be inserted into the groove of the first portion by a sliding motion. The complementary nature of the groove and the tab ensures that the first portion is held in position relative to the second portion.

According to one particular characteristic, the first portion comprises first means of abutment with the second portion and the second portion comprises second means of abutment with the first portion.

Thus, the first and second portions abut each other, enabling the positioning of the second portion relative to the first portion, i.e. the alignment of the proximate edge (the edge closest to the charging plug) of the first portion with the proximate edge of the second portion. This ensures that the two charging plugs are accurately positioned when they are simultaneously inserted into the connectors of the electronic apparatus.

According to one particular characteristic, the housing for inserting a cable is shaped so as to pass through from a distal edge and a proximate edge of the second portion.

The cable is thus inserted through the second portion lengthwise so that the charging plug of the cable is presented in a position adapted to the corresponding connector of the electronic apparatus.

According to one particular characteristic, the housing for inserting a cable comprises a first recess adapted for guiding the cable and a second recess adapted for receiving a head of the cable.

In this way, the cable and the cable head are kept firmly nested in the recesses, enabling appropriate positioning of the plug in height and in depth relative to the connector of the payment device.

According to one particular characteristic, the first recess and the second recess are coaxial.

The cable and the cable head are thus aligned rectilinearly, one after the other.

According to one particular characteristic, the tab has a slot along its length, leading into the first recess and the second recess.

This leading-in enables the cable to be inserted into the housing made in the second portion.

According to one particular characteristic, the device for the securing together of electrical charging cables is made out of a flexible material.

The flexibility of the material makes it possible especially to facilitate the passage of the cable into the second portion, in that the leading-in slot can be widened sufficiently to receive the diameter of the cable. Besides, this widening of the slot compels the sides of the tab to rise externally, enabling the two portions to be held tightly against each other during the insertion of the tab of the second portion into the groove of the first portion.

According to one particular characteristic, the first portion comprises a first charging plug adapted to getting connected to the first connector.

According to one particular characteristic, the first portion comprises an integrated cable provided with a USB plug.

The charging of the electronic device can be done simply by computer, by connecting the USB plug to a USB port of a computer.

4. LIST OF FIGURES

These features as well as others shall appear more clearly from the following description of one embodiment given by way of a simple illustrative and non-exhaustive example and from the appended figures of which:

Figure 7A:
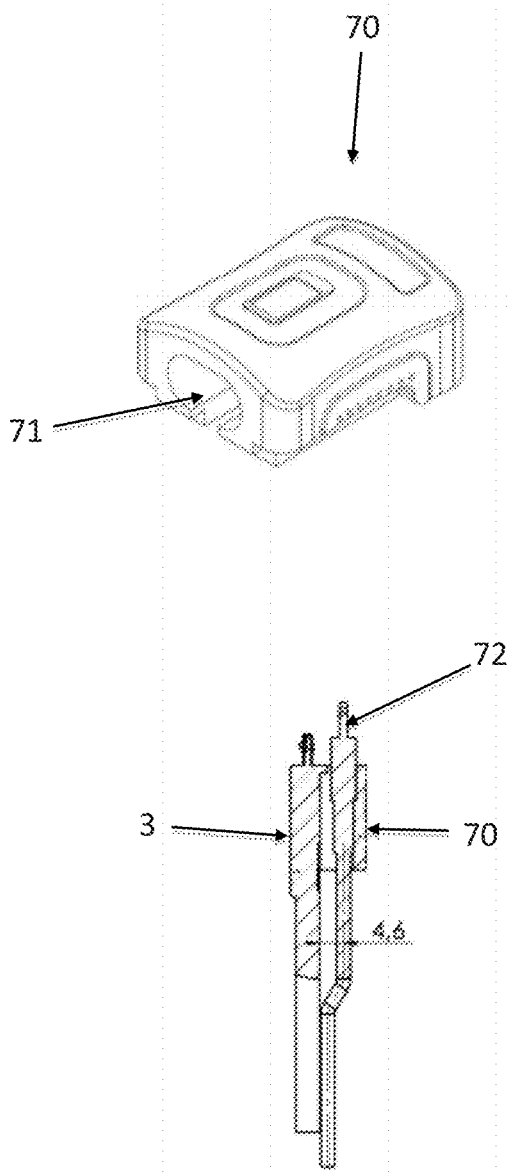
Figure 7B:
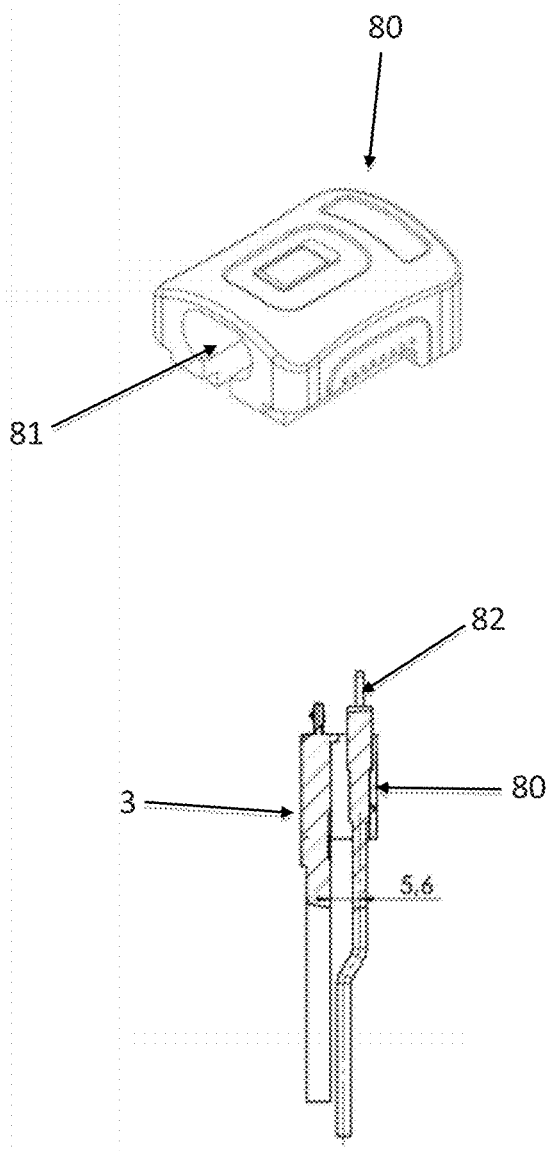
Figure 8:
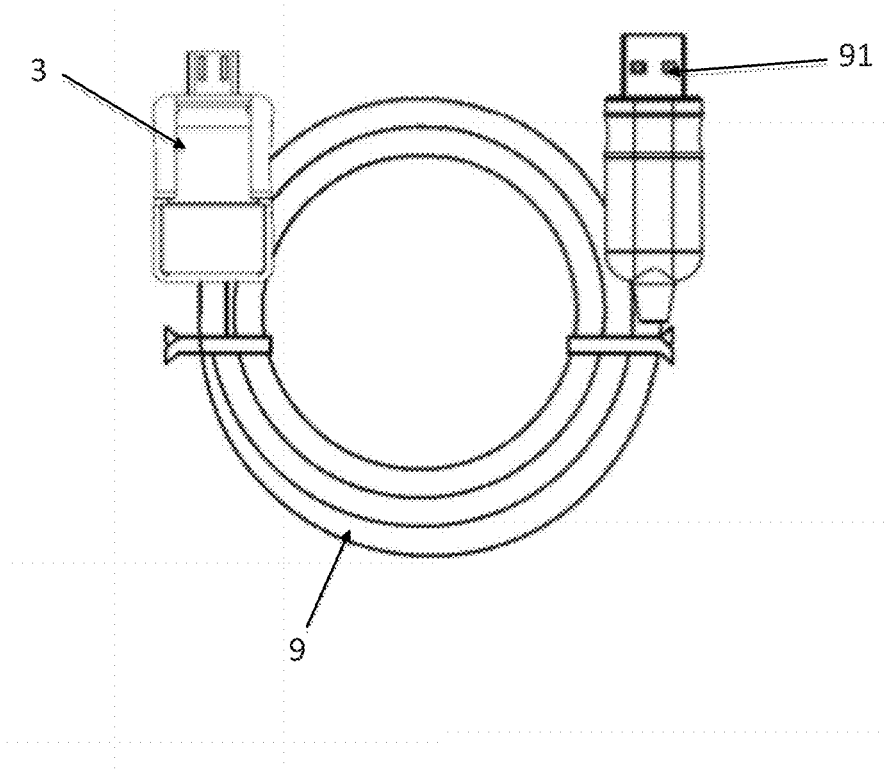

FIGS. 7A and 7B present two types of a second portion that can be adapted to two types of connection cables;

FIG. 8 presents one particular embodiment of the device for the securing together of the cables, when the charging is done by USB.

5. DESCRIPTION OF ONE EMBODIMENT OF THE INVENTION

5.1. General Principle

The general principle of the present technique is that of facilitating the electrical charging of an electronic apparatus comprising two connectors, each connectable to a charging plug by means of a device for the securing together of charging cables. More specifically, this securing is done in proximity to the connection plugs (the plugs that get inserted into the female connectors). Such a device can be used firstly to make sure that the two plugs of the two cables are optimally connected to the corresponding female connectors. Such a device also makes sure that the cables do not get entangled with each other. Such a device enables the insertion of the two plugs of the two cables simultaneously. Such a connector makes sure that when one of the two plugs is accurately inserted, the other plug too is accurately inserted.

Such a device for the securing together of cables comprises two portions:

a first portion for connection to a first connector; and a second portion provided with a housing for inserting a connection cable connected to a second connector.

The first portion can also be provided with a housing for inserting cables, in order to receive a charging cable adapted to the second connector.

The first portion and the second portion are joined together through a securing means belonging to the group comprising clips, screws, systems comprising male and female parts.

The disposition of the two portions is adapted to the disposition of the connectors of the electrical apparatus. The first portion thus faces the first connector while the second portion faces the second connector.

Should the two connectors be situated side by side or one on top of the other, the device enables a simultaneous and facilitated connection to these two connectors.

Here below, one specific embodiment of the invention is described. It is clear however that the invention is in no way limited to this embodiment. The advantages procured by this device of the invention can be obtained with other shapes and other securing means. The proposed technique is based on the availability of a device enabling the securing together of two charging cables, the plugs of which are of a type that is identical (micro-USB) or different (micro-USB and Lightning). It can be specified that the plug of a cable corresponds to that portion of the cable comprising the male connector. Thus, any type of layout and configuration having these characteristics for the charging or simultaneous electrical supply of two connectors joined to each other or proximate to each other is covered by the present technique.

5.2 Description of One Embodiment

Figure 1:
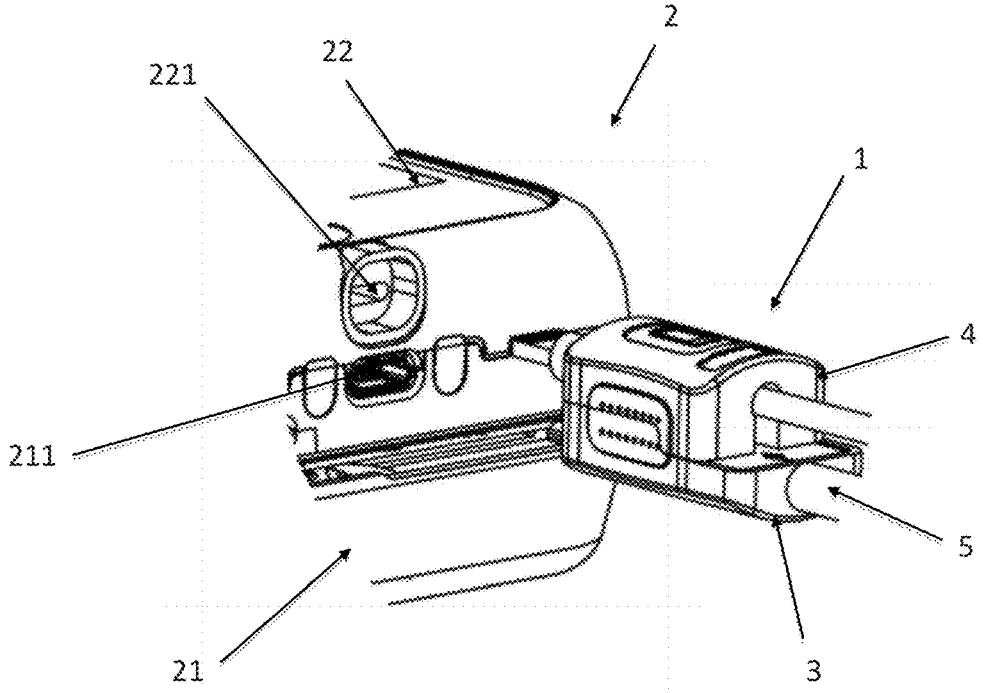
FIG. 1 is a perspective or three-quarter view of the device for the securing together of the cables and an electronic payment device comprising two connectors.
Figure 2:
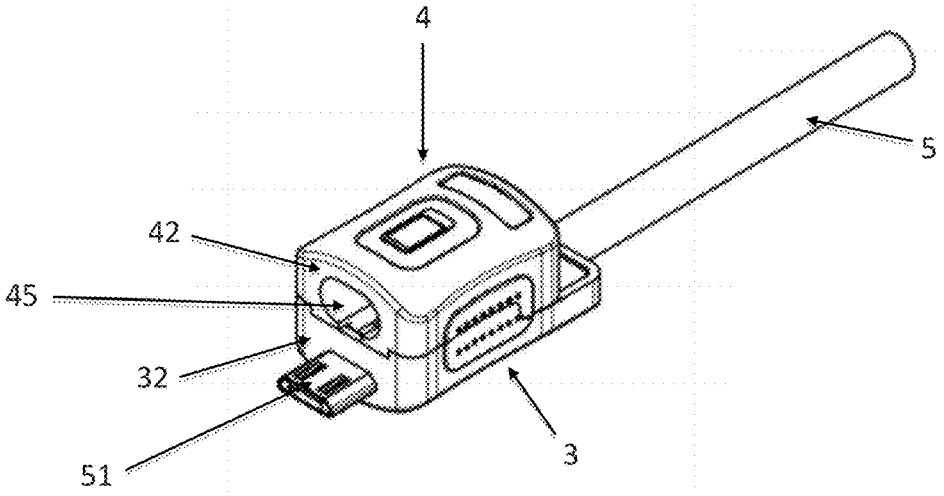
FIG. 2 is a perspective or three-quarter view of the device for the securing of the cable alone.

FIGS. 1 and 2 present a device (1) for the securing together of electrical charging cables of an electronic apparatus (2), especially an electronic payment device in which a payment terminal (21) and a communications terminal (22) are associated in a back-to-back configuration.

Such an electronic payment device, as represented partially in FIG. 1, comprises two connectors (211, 221), a first connector (211) being associated with the payment terminal (21), a second connector (221) being associated with the communications terminal (22).

The payment terminal (21) and the communications terminal (22) can respectively be charged by the connection of these two connectors (211, 221) with charging plugs.

Figure 6:
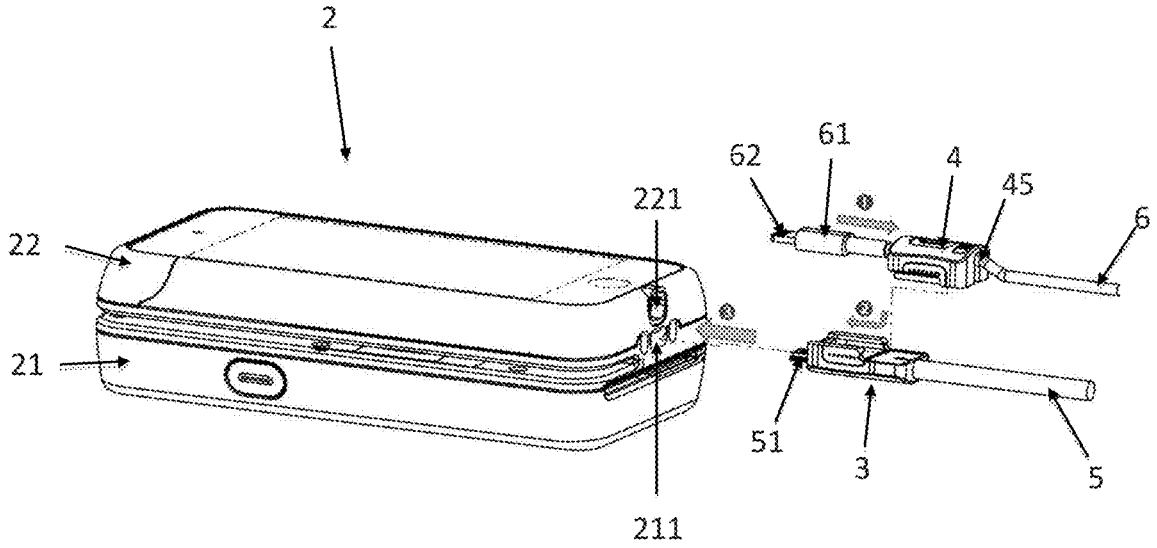
FIG. 6 illustrates the procedure for setting up the device for the securing together of cables for the charging of an electronic payment device.

As presented in FIGS. 1 and 6, the two connectors (211, 221) are placed side by side, making it difficult to insert the two respective charging plugs.

The proposed technique overcomes this drawback by proposing a device (1) for the securing together of cables comprising two complementary portions (3, 4) that get assembled together so as to secure the cables and their corresponding charging plugs, and facilitate their connection with the two connectors (211, 221).

In the embodiment described, a first cable (5) provided with a first charging plug (51) is integrated with the first portion (3). In another embodiment, the first portion (3) can be provided with a housing for inserting a cable in order to receive different types of cables for different types of connectors of electronic apparatuses. In such an embodiment, the first portion (3) then resembles the second portion (4).

Figure 3:
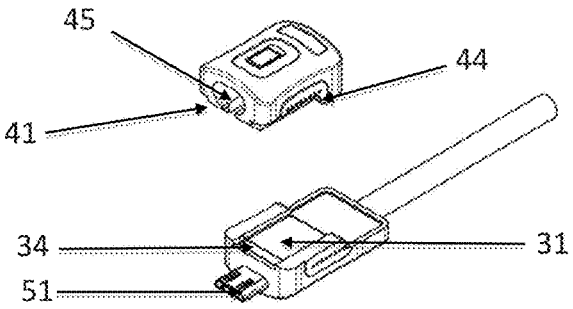
FIG. 3 is an exploded view of the two portions constituting the device for the securing together of the cables.

These two complementary portions (3, 4) are represented in a perspective or three-quarter view in FIGS. 2 and 3. A first portion (3) comprises a T-shaped groove (31) on a part of the length of its upper surface, this groove (31) being used for the sliding guidance of a tab or tongue (41) of a complementary shape formed on the lower surface of a second portion (4).

Figure 4:
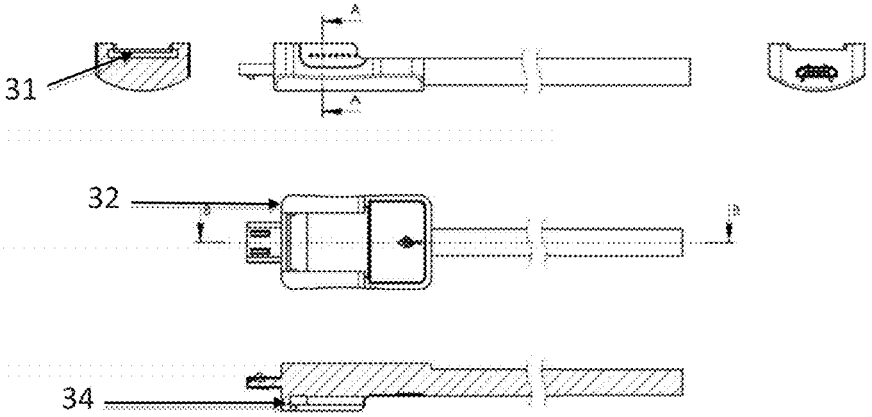
FIG. 4 is a set of views (top view, side view, front view, rear view, section view) of a first portion of the device.

The first portion (3) appreciably forms a block 25 mm long, 15 mm wide and 8 mm high in the embodiment described. The groove (31) extends by about 15 mm on the length of the first portion (3) as illustrated by the set of views of FIG. 4. This groove (31) takes a T-shape extending on about 12 mm over the width of the first portion (3).

Figure 5:
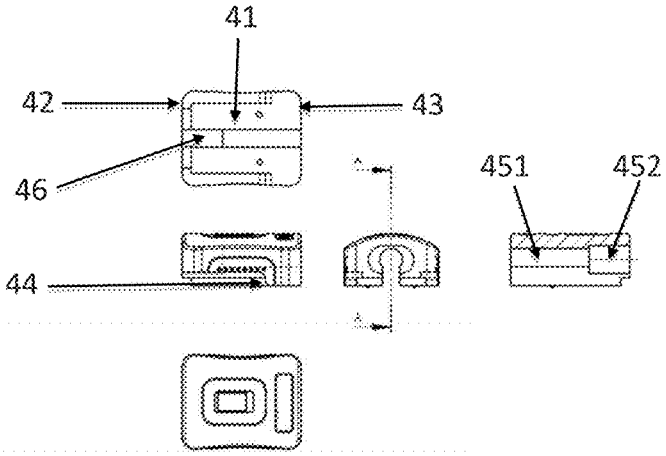
FIG. 5 is a set of views (top view, side view, front view, rear view, section view) of a second portion of the device.

The second portion (4) also appreciably forms a block 20 mm long, 15 mm wide and 8 mm high as illustrated by the set of views of FIG. 5. The tab (41), with the T-shape complementary to the shape of the groove (31), extends on about 15 mm on the length of the second portion (4) and 12 mm on the width of this second portion (4).

The shape and the dimensions of the two portions (3, 4) are given here with reference to the particular embodiment described. They are of course not exhaustive.

The first portion (3) comprises means to abut the second portion (4), and the second portion (4) comprises means to abut the first portion (3). Indeed, the groove (31) is shaped so that it does not lead into the proximate edge (32) of the first portion (3), thus forming a first shoulder (4). The term "proximate edges" herein designates the edges of the portions closest to the charging plugs. By opposition, the term "distal edges" designates the edges of the portions opposite the proximate edges, i.e. those furthest away from the charging plug. The tab (41) for its part is shaped so that it does not lead into the distal edge (43) of the second portion (4), thus forming a second shoulder (44).

Thus, the two shoulders (34, 44) make it possible to position the two portions (3, 4) relative to each other at the end of the sliding guidance of the tab (41) of the second portion (4) in the groove (31) of the first portion (3). The proximate end of the tab (41) comes to abut the first shoulder (34) while at the same time the distal end of the groove (31) comes to abut the second shoulder (34).

This double abutment (34, 44) enables a precise positioning of the first portion (3) and the second portion (4) relative to each other: this means that the proximate edge (32) of the first portion (3) is aligned with the proximate edge (42) of the second portion (4) as shown in FIG. 2. This alignment ensures that the connection of the two portions with the second connectors (211, 221) of the electronic payment device is simultaneous and functional.

The second portion (4) of the device (1) is provided with a housing (45) for inserting a cable (6) as seen in the views of FIGS. 2 and 3. This housing (45) crosses the second portion (4) on its length, from its distal edge (43) up to its proximate edge (42).

As illustrated in FIG. 5, this housing (45) is formed by two adjacent and coaxial recesses (451, 452), a first recess (451) receiving and guiding the inserted cable (6) and a second recess (452) receiving the cable head (61). This cable head (61) comprises a charging plug (62) encased in a protective sheath formed out of the same material as the sheath of the cable (6).

The dimensions of the recesses are adapted respectively to the diameter of the cable (6) and to the dimensions of the cable head (61) so that this cable and cable head are nested into the housing (45). In the embodiment described, the first recess (451) has a diameter substantially equal to 4.5 mm and extends on about 12 mm. The second recess (452) is approximately 7 mm long, 8 mm wide and 5 mm high.

The second recess (452) has dimensions enabling the second charging plug (62) to be positioned appropriately in depth and in height so as to get inserted into the connector (221) of the electronic payment device.

The insertion of the cable (6) into the housing (45) of the second portion (4) is made possible by the presence of a slot (46) made on the length of the tab (41) and leading into the two recesses (451, 452). This slot, which is slightly narrower than the first cable-guiding recess (451), can be widened to let through the cable (6): to this end, the first portion (3) and the second portion (4) are made out of a flexible material of a plastic type so as to be slightly deformable. Besides, the first recess (451) possesses a diameter slightly smaller than that of the cable (6): thus when the cable is in position, it leads to a widening of the slot (46) because of the flexibility of the material of the second portion (4), thus forcing the sides of the tab (41) to rise outwardly. Thus, when the tab (41) of the second portion (4) is inserted into the groove (31) of the first portion (3), the two portions (3, 4) are held tightly against each other.

The process for positioning the device (1) for the securing together of the cables is described with reference to FIG. 6.

In a first stage, a cable (6), comprising a cable head (61) provided with a charging plug (62) is inserted into the housing (45) of the second portion (4) by means of the slot (46). The cable is held and the cable head (61) and the plug (62) are precisely positioned in the housing (45) by means of a sliding motion of the cable (arrow 1).

In a second stage, the tab (41) of the second portion (4) is inserted into the groove (31) of the first portion (3) by a sliding motion (arrow 2). The two portions (3, 4) then abut each other through the two shoulders (34, 44). When this positioning is done, the two charging plugs (51, 62) are disposed in a way that enables them to get inserted appropriately and operationally in the two connectors (211, 221) of the electronic payment device (2).

In a third stage, the two charging plugs (51, 62) are inserted simultaneously (arrow 3) into the two connectors (211, 221); the first plug (51) gets connected to the connector (211) of the payment terminal (21); the second plug (62) gets connected to the connector (221) of the communications terminal (22). The electrical charging of the two terminals (21, 22) is thus simultaneous.

In one particular embodiment, the second portion (4) can be adapted to the communications terminal (22) to be charged. FIGS. 7A and 7B present examples of two types of second portions (70, 80) corresponding to two types of communications terminals. These two types of communications terminals have for example different thicknesses, leading to a variation in the height-wise position of their charging connector. The two types of second portion (70, 80) presented by FIGS. 7A and 7B differ in that the cable-insertion housing (71, 81) is positioned on a different height. In the embodiment described, the position of the charging plug (72, 82) associated with the cable inserted into the housing (71, 81) thus varies by 1 mm in height.

FIG. 8 illustrates one particular embodiment in which the charging of the payment terminal is done by computer. More specifically, the charging is done by USB means. To this end, the first portion (3) has a cable (9) secured to this first portion (3), such a cable being provided at its extremity with a USB plug (91) capable of getting connected with the USB port of a computer.

The invention claimed is:

1. Device for securing together cables for the electrical charging of an electronic apparatus, the device comprising:

a first portion integrating a first cable having a first plug for connection to a first connector of said electronic apparatus, and a second portion provided with a housing for the insertion of a second connection cable having a second plug for connection to a second connector of said electronic apparatus, said housing comprising a first recess adapted for guiding said second cable and a second recess adapted for receiving a head of said second cable, said first portion and said second portion being secured together by a securing arrangement.

2. Device for securing electric charging cables together according to claim 1, wherein said securing arrangement comprises:

a T-shaped groove formed on an upper surface of said first portion, and a tab formed on a lower surface of said second portion.

3. Device for securing electric charging cables together according to claim 1, wherein said first portion comprises a first abutment with said second portion and said second portion comprises a second abutment with said first portion.

4. Device for securing electric charging cables together according to claim 1, wherein said housing for inserting a cable is shaped so as to pass through from a distal edge to a proximate edge of said second portion.

5. Device for securing electric charging cables together according to claim 1, wherein said first recess and said second recess are coaxial.

6. Device for securing electric charging cables together according to claim 2, wherein said tab has a slot along its length, leading into said first recess and said second recess.

7. Device for securing electric charging cables together according to claim 1, wherein said device is made out of a flexible material.

8. Device for securing electric charging cables together according to claim 1, wherein said first portion comprises a first charging plug adapted to get connected to said first connector.

9. Device for securing electric charging cables together according to claim 1, wherein said first portion comprises an integrated cable provided with a USB plug.

* * * * *